US010519018B2

(12) United States Patent
Zoni et al.

(10) Patent No.: US 10,519,018 B2
(45) Date of Patent: Dec. 31, 2019

(54) RECEPTACLE HANDLING APPARATUS FOR FILING AND CAPPING RECEPTACLES

(71) Applicant: Sidel Participations, Octeville-sur-Mer (FR)

(72) Inventors: Roberto Zoni, Parma (IT); Nicola Raffaini, Parma (IT); Stefano Pini, Parma (IT)

(73) Assignee: SIDEL PARTICIPATIONS, Octeville-sur-mer (FR)

( * ) Notice: Subject to any disclaimer, the term of this patent is extended or adjusted under 35 U.S.C. 154(b) by 310 days.

(21) Appl. No.: 15/402,586

(22) Filed: Jan. 10, 2017

(65) Prior Publication Data

US 2017/0217748 A1 Aug. 3, 2017

(30) Foreign Application Priority Data

Jan. 28, 2016 (EP) ..... 16305078

(51) Int. Cl.
*B67C 7/00* (2006.01)
*B67C 3/24* (2006.01)

(52) U.S. Cl.
CPC ..... *B67C 7/0053* (2013.01); *B67C 3/24* (2013.01)

(58) Field of Classification Search
CPC .. B67C 3/24; B67C 3/26; B67C 7/004; B67C 7/0046; B67C 7/0053
USPC ..... 53/276, 279, 280, 282
See application file for complete search history.

(56) References Cited

U.S. PATENT DOCUMENTS 2,621,841 A * 12/1952 Simpson ..... B67C 7/0046 53/279
3,771,284 A * 11/1973 Boeckmann ..... B67B 3/2033 53/282
4,511,027 A * 4/1985 Zamboni ..... B67C 7/0006 198/470.1
4,574,559 A * 3/1986 Rutter ..... B65B 7/28 53/268

(Continued)

FOREIGN PATENT DOCUMENTS

EP 2 179 960 A1 4/2001
EP 2179960 A1 * 4/2010 ..... B65G 47/847
WO WO 2011/029856 A2 3/2011

OTHER PUBLICATIONS

European Search Report dated Jun. 30, 2016, 2 pages.

*Primary Examiner* — Hemant Desai
*Assistant Examiner* — Christopher Robin Kim

(57) ABSTRACT

The present disclose relates to a receptacle handling apparatus. In one implementation, the apparatus includes a filling carousel with filling units adapted for filling respective receptacles during advancement of the receptacles from a receiving station to a transfer station and a capping carousel with capping units adapted for receiving respective filled receptacles at an insertion station and adapted to cap said receptacles during advancement from the insertion station to a release station. The transfer station and the insertion station are spaced apart, and the capping carousel includes gripping units, each having at least one outwardly extensible gripping arm assembly moveable between a retracted and an extracted configuration, such that the gripping arm assembly cooperates with the filling carousel to transfer a relative filled receptacle from the transfer station to the insertion station.

12 Claims, 3 Drawing Sheets

(56) References Cited

U.S. PATENT DOCUMENTS

| | | | | |
|---|---|---|---|---|
| 4,930,614 | A * | 6/1990 | Kronseder | B08B 9/205 141/146 |
| 9,242,842 | B2 * | 1/2016 | Klenk | B65G 47/847 |
| 2010/0077703 | A1 * | 4/2010 | Gourlaouen | B65G 47/847 53/473 |
| 2017/0217748 | A1 * | 8/2017 | Zonni | B67C 3/24 |

* cited by examiner

RECEPTACLE HANDLING APPARATUS FOR FILING AND CAPPING RECEPTACLES

This application claims priority to European Patent Application EP16305078.4 filed on Jan. 28, 2016, the contents which are incorporated herein by reference in their entirety.

TECHNICAL FIELD

The present invention relates to a receptacle handling apparatus, in particular for filling with a pourable product and capping receptacles of any type, such as containers or bottles made of base components like glass, plastics, aluminum, steel and composites.

The present invention may be used to particular advantage for filling the mentioned receptacles with carbonated liquids (including sparkling water, soft drinks and beer), non-carbonated liquids (including still waters juices, teas, sport drinks, liquid cleaners, wise, etc), emulsions, suspensions, high viscosity liquids, beverages containing pulps and for subsequently capping said receptacles with receptacle closures such as screw caps, sports caps, crown corks, stoppers or the like.

BACKGROUND ART

Two main kinds of handling apparatuses are commonly known for filling and capping receptacles.

A first kind of handling apparatus comprises one single conveying carousel provided with a plurality of peripherally-arranged handling units for filling and capping respective receptacles. In particular, each handling unit comprises both filling means for filling the receptacles and capping means for capping the receptacles during rotation of the single conveying carousel.

This kind of handling apparatus has the advantage that the capping is performed immediately after the tilling without requiring any transfer of the receptacles and so avoiding possible losses of the product during the transfer itself. However, since each handling unit is equipped with both filling and capping means, the single conveying carousel has a quite complicated structure and a considerable size; in addition, this kind of handling apparatus entails complicated control means and high costs.

A second kind of handling apparatus comprises two distinct carousels for respectively filling the receptacles with a pourable product and for capping the filled receptacles.

In particular, the filling carousel is mounted to rotate around a first axis and is provided with a plurality of filling units peripherally arranged on the filling carousel itself and angularly spaced to each other around said first axis. Each filling unit is adapted to fill one respective receptacle during the rotation, of the filling carousel around the first axis.

The capping carousel is arranged spaced apart from the filling carousel and is mounted to rotate around a second axis parallel to the first axis. The capping carousel is provided with a plurality of capping units peripherally arranged on the capping carousel itself and angularly spaced to each other around the second axis. Each capping unit is configured to cap one respective filled receptacle during rotation of the capping unit.

This second kind of handling apparatus further comprises one or more transfer star wheels interposed between the filling carousel and the capping carousel and adapted to transfer the filled receptacles from one respective filling unit to one respective capping unit.

The continuous demand for increasing the output rate of the receptacle handling apparatuses poses issues on the transfer of the filled receptacles from one carousel to the next with possible losses of the product, especially at high speeds (more than 40000 bottles per hour).

DISCLOSURE OF INVENTION

It is therefore an object of the present invention to provide an apparatus and a method to overcome the aforementioned drawbacks.

According to the present invention, there is provided an apparatus as claimed in claim 1.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
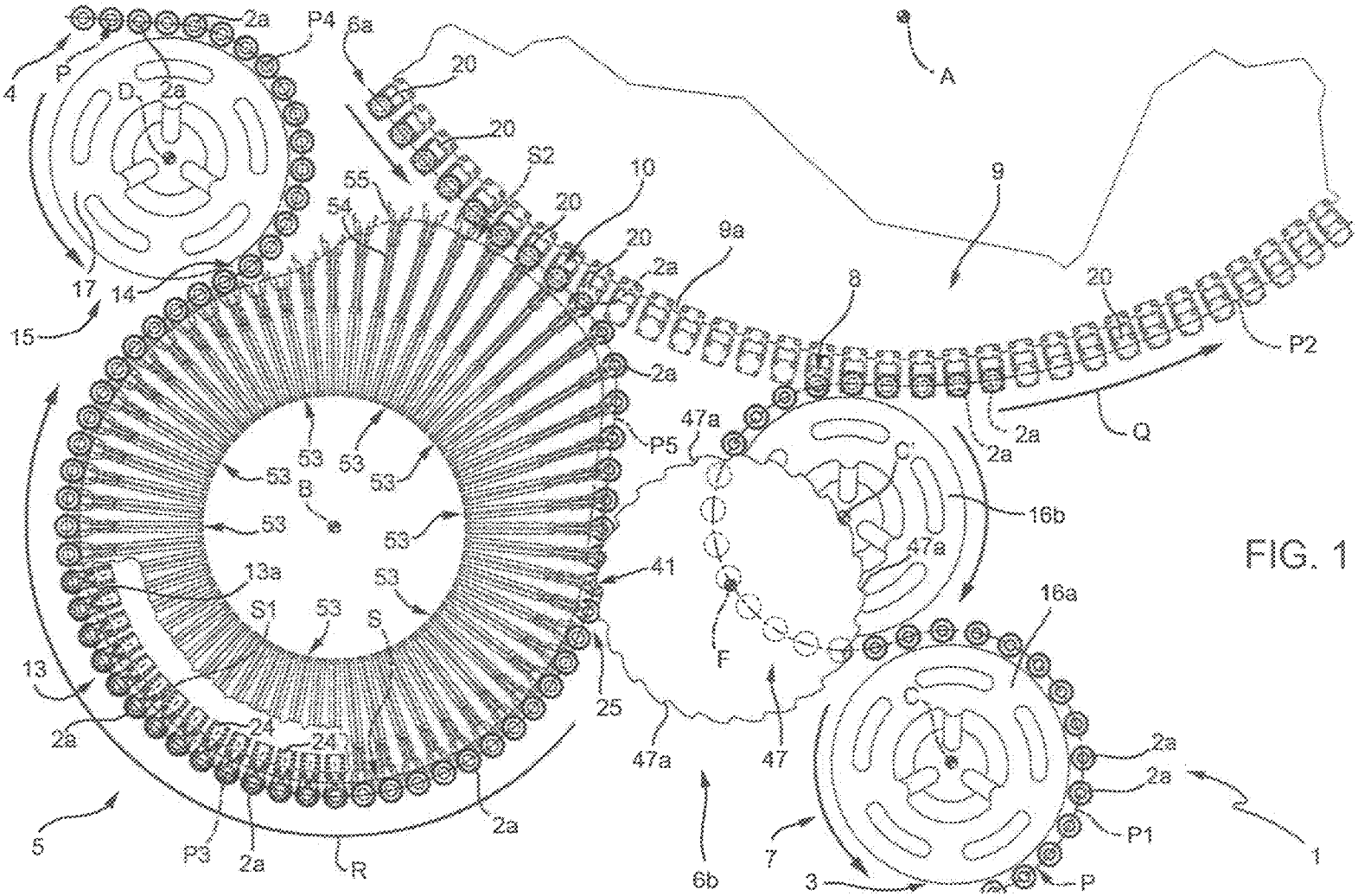
FIG. 1 shows an apparatus according to the present invention, with parts removed for clarity.

Number 1 in FIG. 1 indicates as a whole a handling apparatus for filling and capping receptacles 2*a* according to the present invention.

Apparatus 1 comprises;

- a receptacle inlet station 3 at which apparatus 1 receives receptacles 2*a* to be filled;
- a receptacle outlet station 4 at which receptacles 2*a*, in particular filled and capped receptacles 2*a* exit apparatus 1;
- conveying means 5 adapted to advance receptacles 2*a* along a path P from the receptacle inlet station 3 to the receptacle outlet station 4; and
- a tilling device 6*a* adapted to fill receptacles 2*a* during advancement along path P; and
- a capping device 6*b* configured to apply one respective receptacle closure 2*b* onto each one of the receptacles 2*a*, in particular each one of the filled receptacles 2*a* during advancement along path P.

Conveying means 5 comprise;

- a feeding device 7 adapted to advance receptacles 3 from inlet station 3 to a receiving station 8, located downstream of inlet station 3, along a portion P1 of path P;
- a filling carousel 9 arranged downstream, of feeding device 7 along path P, adapted to rotate around, a corresponding central axis A, in particular having a substantially vertical orientation, and configured to advance receptacles 2*a* from receiving station 8 to a transfer station 10 along an arc-shaped portion P2 of path P;
- a capping carousel 13 arranged downstream of, and spaced apart from, filling carousel 9, rotatable around a respective central axis B, parallel to axis A, and configured to advance receptacles 2*a* from transfer station 10 to a release station 14 along a portion P3 of path P; and
- an outlet conveying device 15 arranged downstream of capping carousel 13 and designed to advance receptacles 2*a* from release station 14 to outlet station 4 along an arc-shaped portion P4 of path P.

In more detail, feeding device 7 comprises one or more, in the specific example of FIG. 1 two star wheels 16*a*, 16*b*, each one adapted to rotate around one respective rotation axis C, C' parallel to axes A and B.

Additionally, star wheel 16*b* is peripherally adjacent, in particular tangential to filling carousel 9 at receiving station 8.

Furthermore, outlet conveying device 15 has at least one star wheel 17 adapted to rotate around a respective rotational axis D parallel to axes A, B, C and C'.

In particular, star wheel 17 is arranged peripherally adjacent, in particular tangential to capping carousel 13 at release station 14.

In more detail, filling device 6*a* comprises a plurality of filling units 20 arranged along a peripheral portion 9*a* of filling carousel 9 and equally spaced around axis A. Filling units 20 advance along a path Q, in particular being circular through receiving station 8 and transfer station 10 by rotation of filling carousel 9 around axis A.

Each filling unit 20 is adapted to receive one respective receptacle 2*a* at receiving station 8 and to fill the respective receptacle 2*a* with the pourable product in a manner known as such during advancement, of filling unit 20 from receiving station 8 to transfer station 10 and, accordingly, during advancement of the respective receptacle 2*a* along portion P2 of path P.

Figure 2:
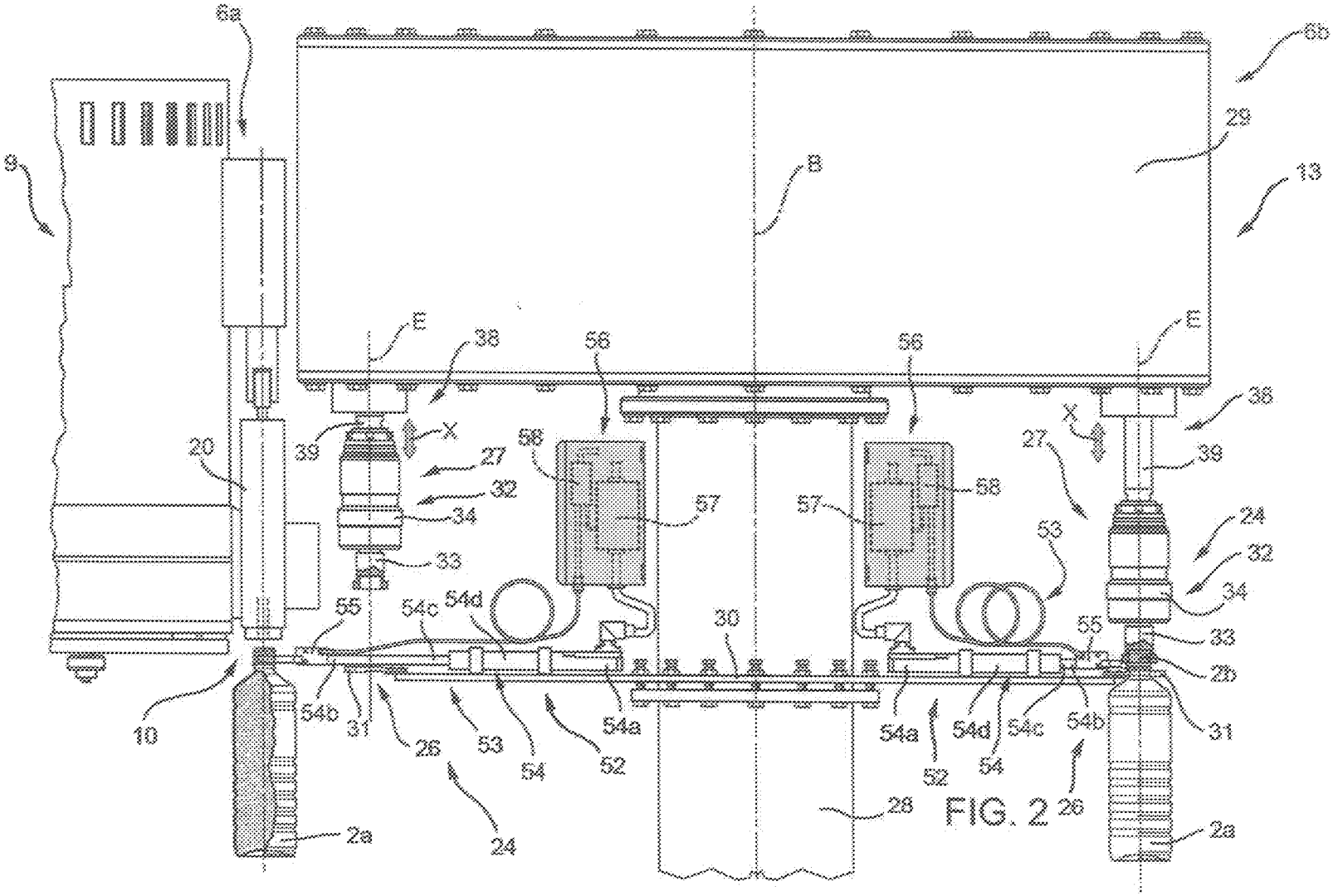
FIG. 2 shows a first detail of the apparatus of FIG. 1, with parts removed for clarity.
Figure 3:
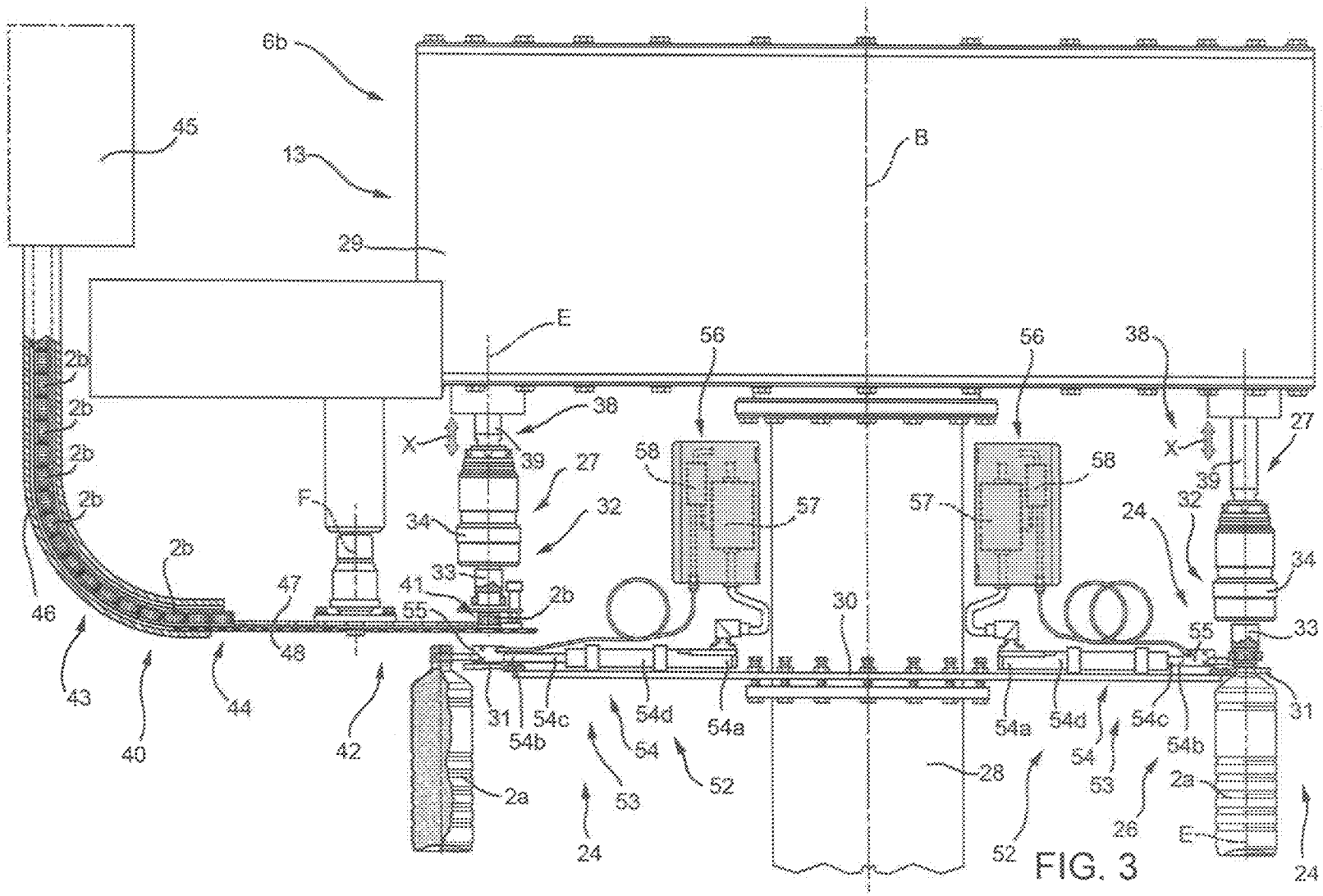
FIG. 3 shows a second detail of the apparatus of FIG. 1, with parts removed for clarity.

With particular reference to FIGS. 2 and 3, capping device 6*b* comprises a plurality of capping units 24 arranged along a peripheral portion 13*a* of capping carousel 13 and equally spaced around axis B and configured to advance along a capping unit path R, in particular being circular, through rotation of capping carousel 13 around axis B. In particular, each capping unit 24 advances through release station 14 and an insertion station 25. Insertion station 25 is spaced apart from transfer station 10 and, in particular, insertion station 25 is placed downstream of transfer station 10 and upstream of release station 14 along path P.

Furthermore, each capping unit 24 is adapted to receive one respective receptacle 2*a*, in particular one respective filled receptacle 2*a* at insertion station 25 and to cap the respective receptacle 2*a* with one respective receptacle closure 2*b* during advancement of capping unit 24 and, accordingly, of receptacle 2*a* from insertion station 25 to release station 14.

Each capping unit 24 comprises:

- a retaining assembly 26 adapted to retain one respective receptacle 2*a* during advancement of the respective receptacle 2*a* from insertion station 25 to release station 14; and
- a closure fastening device 27 adapted to fasten one respective receptacle closure 2*b* on the respective receptacle 2*a* retained by the respective retaining assembly 26.

Furthermore, capping carousel 13 comprises:

- a rotating shaft 28 defining axis B of capping carousel 13 and adapted to rotate around axis B;
- an upper platform 29 having a substantially horizontal configuration, being mounted to shaft 28, being configured to rotate around axis B together with shaft 28 and carrying the corresponding closure fastening devices 27 of the plurality of capping units 24; and
- a lower support disc 30 mounted to shaft 28, having a substantially horizontal orientation, being arranged parallel and below upper platform 29, being configured to rotate around axis B together with shaft 28 and being designed to carry retaining assemblies 26 of the plurality of capping units 24.

In more detail, each retaining assembly 26 comprises a retaining element, in particular a gripper 31, in particular peripherally mounted to lower support disc 30 and apt to retain the respective receptacle 2*a* during advancement of the respective receptacle 2*a* from insertion station 25 to release station 14 and to release the respective receptacle 2*a* at release station 14.

Each closure fastening device 27 comprises a closure fastening head assembly 32 adapted to cooperate with one respective receptacle closure 2*b* and to fasten the respective receptacle closure 2*b* to one relative receptacle 2*a*.

More specifically, each closure fastening head assembly 32 comprises:

- a fastening head 33 adapted to engage with the respective receptacle closure 2*b* and designed to rotate around one respective rotation axis E parallel to axes A, B, C, C' and D for fastening the respective receptacle closure 2*b* on the respective receptacle 2*a*; and
- a drive assembly 34 apt to actuate rotation of the respective fastening head 33 around axis E.

Each closure fastening device 27 further comprises a displacement assembly 38 adapted to move the respective closure fastening head assembly 32 between an operative configuration (see e.g. the closure fastening device 27 shown on the right side of FIGS. 2 and 3), in which the respective closure fastening head assembly 32 is designed to apply and fasten the receptacle closure 2*b* on one respective receptacle 2*a*, and a rest configuration (see e.g. the closure fastening device 27 shown on the left side of FIG. 2), in which the respective closure fastening head assembly 32 is moved away from lower support disc 30 with respect to the operative configuration.

In particular, displacement assembly 38 comprises a displacement bar 39 moveable into a direction X parallel to axis E and being designed to carry the respective closure fastening head assembly 32. More specifically, each displacement bar 39 is designed to extract towards the respective retaining assembly 26, in particular the respective gripper 31 of the respective capping unit 24 for moving the respective closure fastening head assembly 32 into its operative configuration or to retract away from the respective retaining assembly 26, in particular the respective gripper 31 of the respective capping unit 24 for moving the respective closure fastening head assembly 32 into its rest configuration.

With particular reference to FIGS. 1 and 3, capping device 6*b* further comprises a receptacle closure feeding unit 40 adapted to feed receptacle closures 2*b* to a closure engagement station 41 substantially downstream of transfer station 10 and upstream of insertion station 25 along path P.

Furthermore, each closure fastening head assembly 27 is configured to engage with one respective receptacle closure 2*b* at closure engagement station 41. In particular, in use, each closure fastening head assembly 32 is configured to engage with the respective receptacle closure 2*b* at closure engagement station 41 during movement from the relative rest position to the relative operative configuration.

With reference to FIG. 3, receptacle closure feeding unit 40 comprises:

- a closure feeding assembly 42 arranged adjacent to capping carousel 13 and configured to feed receptacle closures 2*b* to closure engagement station 41; and
- a receptacle closure distributor 43 hosting receptacle closures 2*b* and designed to feed receptacle closures 2*b* to closure feeding assembly 42, in particular to a closure entrance station 44.

More specifically, receptacle closure distributor 43 has a magazine 45 configured to provide for the receptacle closures 2*b* and a guide channel 46 designed to direct receptacle closures 2*b* to closure entrance station 44.

In more detail, closure feeding assembly 42 comprises a rotating disc 47 rotatable around a respective central rotation axis F parallel to axes A, B, C, C', D and E and adapted to advance each receptacle closure 2*b* from closure entrance station 44 to closure engagement station 41. More specifically, rotating disc 47 is peripheral adjacent, in particular tangent to capping carousel 13 at closure engagement station 41. Even more particularly, rotating disc 47 is positioned above lower support disc 30 of capping carousel 13.

Even more specifically, rotating disc 47 comprises a plurality of peripheral interaction portions 47*a*, each one adapted to interact with one respective receptacle closure 2*b* for advancing the respective receptacle closure 2*b* from closure entrance station 44 to closure engagement station 41.

Furthermore, each closure feeding assembly 42 comprises a fixed disc 48 positioned parallel to and below rotating disc 47 and designed to support receptacle closure 2*b* during advancement from closure entrance station 44 to closure engagement station 41. As well, fixed disc 48 is placed above lower support disc 30 of capping carousel 13.

Additionally, receptacle closure feeding unit 40 comprises a support structure (known as such and not described in detail) designed to carry receptacle closure distributor 43 and closure feeding assembly 42.

With reference to FIGS. 1 to 3, apparatus 1 further comprises a plurality of gripping units 52, each one adapted to receive one respective receptacle 2*a* at transfer station 10 and to advance the respective receptacle 2*a* to insertion station 25.

Capping carousel 13 comprises the plurality of gripping units 52, each of which is associated to one respective capping unit 24.

As a possible alternative not shown, the plurality of gripping units 52 may be carried by, or form part of, filling carousel 9.

Furthermore, each gripping unit 52 is advanced by rotation of capping carousel 13 around axis B through insertion station 25, release station 14 and transfer station 10.

Each gripping unit 52 has at least one outwardly extensible gripping arm assembly 53, in the specific example one, moveable between a retracted and an extracted configuration and being configured to receive one respective receptacle 2*a* from one respective filling unit 20 at transfer station 10 and to advance the respective receptacle 2*a* along a sub-portion P5 of path P, in particular of portion P3 to insertion station 25 for delivering the receptacle 2*a* to one respective capping unit 24 at insertion station 25. In particular, sub-portion P5 has a non-circular arc-shaped profile.

Additionally, each gripping arm assembly 53 is radially moveable between the retracted configuration and the extracted configuration with respect to the respective axis B.

Furthermore, each gripping arm assembly 53 is configured to receive the respective receptacle 2*a* at transfer station 10 in its extracted configuration and to deliver the respective receptacle 2*a* to the corresponding capping unit 24 in its retracted configuration.

Each gripping arm assembly 53 comprises:

- a gripper arm 54 mounted to capping carousel 13, in particular to lower support disc 30 with a first end portion 54*a* and configured to selectively and radially move, in particular to extract to an extracted arrangement or to retract to a retracted arrangement; and
- a gripping element 55 coupled to a second end portion 54*b* of gripper arm 54 and configured to selectively retain the respective receptacle 2*a* during advancement from transfer station 10 to insertion station 25.

The retracted and extracted arrangement of each gripper arm 54 defines the retracted and extracted configuration, respectively, of the respective gripping arm assembly 53.

In more detail, gripper arms 54 are equally spaced around axis B in correspondence with the respective capping units 24; and gripper elements 55 can be in a closed or open configuration for selectively gripping the respective receptacles 2*a*. Additionally, in use, each gripping element 55 advances along a path S.

Furthermore, in the specific example disclosed, each gripping arm 54 is designed as a linear motor having a magnetic slider 54*c* carrying the second end portion 54*b* of gripping arm 54 and a magnetic stator (coil portion) 54*d* of gripping arm 54 carrying first end portion 54*a*. More specifically, each slider 54*c* is configured to radially move, in particular to extract or retract.

Furthermore, each gripping unit 52 comprises an actuation unit 56 adapted to control the respective gripping arm assembly 53.

More specifically, each actuation unit 56 comprises:

- a first actuation device 57 adapted to actuate the radial movement, in particular the retraction or extraction of the respective gripping arm 54; and
- a second actuation device 58 adapted to control the respective gripping element 55 for selectively retaining or releasing the respective receptacle 2*a*.

In particular, each first actuation device 57 is designed to control the respective gripper arm 54 by electrical means, in particular selectively actuating the respective magnetic stator (coil portion) 54*d* for radially moving the respective slider 54*c*.

Alternatively, each gripper arm 54 could be designed as a pneumatic piston-cylinder arrangement and accordingly, the first actuation device 57 would actuate the respective gripper arm 54 by pneumatic means.

Furthermore, each second actuation device 58 actuates the respective gripping element 55 by pneumatic means. Alternatively, each gripping element 55 and the respective second actuation device 58 could rely on electromagnetic means.

In use, conveying means 5 convey a succession of receptacles 2*a* along path P from inlet station 3 to outlet station 4 and filling device 6*a* and capping device 6*b* fill and cap, respectively each receptacle 2*a* during advancement of receptacles 2*a* along path P.

More specifically, feeding device 7 advances receptacles 2*a*, in particular empty receptacles 2*a* from inlet station 3 to receiving station 8 and feeds each receptacle 2*a* at receiving station 3 to one respective filling unit 20 advancing along path Q.

Each filling unit 20 fills the respective receptacle 2*a* with the pourable product during advancement of filling unit 20 and of the respective receptacle 2*a* from receiving station 8 to transfer station 10.

Concurrently, capping carousel 13 rotates around axis B advancing thereby each capping unit 24 along path R. Furthermore, each gripping unit 42 advances by the rotation of capping carousel 13 around axis B.

Additionally, during advancement of each gripping unit 52 by rotation of capping carousel 13 around axes B each respective gripping arm assembly 53 is moved from its retracted to its extracted configuration and from its extracted configuration to its retracted configuration. In particular, each gripping arm assembly 53 is moved from the retracted to the extracted configuration during advancement from substantially the area of release station 14 to the area of transfer station 10 and from extracted configuration to retracted configuration during advancement from substantially the area of transfer station 10 to the area of insertion station 25. Each gripping arm assembly 53 remains in its retracted configuration during advancement from insertion station 25 to release station 14. Accordingly, each gripping element 55 advances along a circular arc-shaped portion S1 of path S between insertion station 25 and release station 14 and a non-circular arc-shaped portion S2 between release station 14 to insertion station 25.

At transfer station 10 each receptacle 2*a*, in particular each filled receptacle 2*a* is transferred from the respective filling unit 20 to one respective gripping unit 52. In particular, the respective gripping arm assembly 53 receives the relative receptacle 2*a* at transfer station 10 while being in its extracted configuration. Even more particularly, the respective gripping arm 54 is extracted and the respective gripping element 55 receives the relative receptacle 2*a*.

Upon further rotation of capping carousel 13 around axis B and further advancement of the respective gripping unit 52 the respective gripping element 55 advances along portion S2 of path S. Concurrently, the respective receptacle 2*a* advances along sub-portion P5 of path P from transfer station 10 to insertion station 25. As sub-portion P5 is substantially identical to portion S2 also sub-portion P5 has a non-circular arc-shaped profile.

Accordingly, each receptacle 2*a* advancing from transfer station 10 to insertion station 25 advances along a non-circular arc-shaped profile.

At insertion station 25 each receptacle 2*a* is delivered to one respective capping unit 24. In more detail, each receptacle 2*a* is delivered to the respective retaining assembly 26, in particular the relative gripper 31 at insertion station 25 and is retained by the respective retaining assembly 26, in particular the relative gripper 31 during advancement of receptacle 2*a* from insertion station 25 to release station 14. Thus, each receptacle 2*a* advances along a respective circular arc-shaped section of path P between insertion station 25 and release station 14, in particular this circular arc-shaped section is substantially parallel to portion S1 of path S.

Furthermore, during advancement of each receptacle 2*a* from insertion station 25 to release station 14, each receptacle 2*a* is capped with one respective receptacle closure 2*b*. In particular, the respective receptacle closure 2*b* of each receptacle 2*a* fed to closure engagement station 41 by receptacle closure feeding unit 40, is received by the respective closure fastening head assembly 32 moving from the corresponding rest configuration to the corresponding operative configuration at closure engagement station 41 and is attached on the relative receptacle 2*a* at substantially insertion station 25. Then, the respective receptacle closure 2*b* is fastened by actuation of fastening head 33 during advancement of receptacle 2*a* from insertion station 25 to release station 14. Prior to release station 14 the respective closure fastening head assembly 32 moves from the extracted configuration to the retracted configuration for detaching from the respective receptacle closure 2*b*. This allows each receptacle 2*a*, in particular each filled and capped receptacle 2*a* to be transferred at release station 14 to outlet conveying device 15. Outlet conveying device 15 advances each receptacle 2*a*, in particular each filled and capped receptacle 2*a* to outlet station 4.

The advantages of apparatus 1 according to the present invention will be clear from the foregoing description.

In particular, apparatus 1 provides for a reduced size as capping carousel 13 is arranged immediately downstream of filling carousel 9 and no further transfer device, such as a transfer device having one or more star wheels is required for advancing filled receptacles after being advanced by the filling carousel and prior to being advanced by the capping carousel.

A further advantage is that gripping units 52 are configured to advance filled receptacles 2*a* along a non-circular arc-shaped sub-portion P5 of path P, thereby avoiding a loss of the pourable product from the filled receptacles. Otherwise, a direct insertion of the filled receptacles into the respective capping units 24 at transfer station 10 would inevitably lead to a loss of pourable product considering the processing speeds of this kind of filling and capping apparatuses.

Clearly, changes may be made to apparatus 1 and the method as described herein without, however, departing from the scope of protection as defined in the accompanying claims.

The invention claimed is:

1. A receptacle handling apparatus, comprising:

a filling carousel rotatable about a first axis for transporting receptacles along a receptable transport path from a receiving station to a transfer station;

a plurality of filling units mounted peripherally on the filling carousel and advanced along a circular path by the filling carousel, the filling units configured to fill respective receptacles with a pourable product during advancement of the receptacles along the receptacle transport path, the receptacle transport path extending about the first axis from the receiving station to the transfer station along an arc-shaped portion of the circular path;

a capping carousel rotatable about a second axis parallel to the first axis;

a plurality of capping units mounted peripherally on the capping carousel and configured to advance along a circular capping path;

an insertion station at which the capping carousel receives filled receptacles; and a closure engagement station at which the capping carousel caps the receptacles during advancement of the receptacles about the second axis from the insertion station to a release station, wherein the transfer station of the filing carousel and the insertion station of the capping carousel are spaced apart, and wherein the capping carousel is located downstream of the filling carousel and comprises a plurality of peripherally mounted gripping units, the gripping units having at least one outwardly extensible gripping arm assembly, the at least one gripping arm assembly including a gripping arm, the gripping arm being moveable between a retracted configuration and an extracted configuration such that the at least one gripping arm assembly cooperates with the filling carousel to transfer a filled receptacle along a non-circular arc-shape sub-portion of the receptacle transfer path from the transfer station of the filling carousel directly to the insertion station of the capping carousel without interposition of any further transfer device between the filling carousel and the capping carousel, and wherein each gripping unit comprises an actuation unit, each actuation unit controlling a corresponding gripping arm assembly and including a first actuation device for radially moving the corresponding gripping arm assembly between the retracted configuration and the extracted configuration.

2. The apparatus according to claim 1, wherein the at least one gripping arm assembly is radially moveable between the retracted configuration and the extracted configuration with respect to one of the first and second axes.

3. The apparatus according to claim 1, wherein the at least one gripping arm assembly is configured to receive a receptacle at the transfer station in its extracted configuration and to deliver the receptacle to one of the capping units in its retracted configuration.

4. The apparatus according to claim 1, wherein each capping unit comprises a retaining assembly configured to:

receive the receptacle from the gripping unit at the insertion station; and retain said receptacle during advancement from the insertion station to the release station.

5. The apparatus according to claim 1, wherein the at least one gripping arm assembly further comprises a gripping element coupled to a second end portion of the gripping arm and configured to selectively retain the receptacle during advancement from the transfer station to the insertion station.

6. The apparatus according to claim 5, wherein each actuation unit further comprises a second actuation device configured to control the gripping element to selectively retain or release a receptacle.

7. The apparatus according to claim 6, wherein the second actuation device comprises a pneumatic device.

8. The apparatus according to claim 6, wherein the second actuation device comprises an electromagnetic device.

9. The apparatus according to claim 1, wherein the gripping arm has a first end portion and a second end portion, the gripping arm comprising a linear motor having a magnetic slider carrying the second end portion of the gripping arm; and a magnetic stator carrying the first end portion of the gripping arm, wherein the first actuation device is configured to selectively activate the magnetic stator to radially move the magnetic slider and thereby actuate radial movement of the gripping arm.

10. The apparatus according to claim 9, wherein the at least one gripping arm assembly further comprises a gripping element coupled to the second end portion of the gripping arm, and wherein each actuation unit further comprises a second actuation device configured to control the gripping element to selectively retain or release a receptacle.

11. The apparatus according to claim 10, wherein the second actuation device comprises a pneumatic device.

12. The apparatus according to claim 10, wherein the second actuation device comprises an electromagnetic device.

* * * * *